US008397660B2

(12) United States Patent
Beach et al.

(10) Patent No.: US 8,397,660 B2
(45) Date of Patent: Mar. 19, 2013

(54) PROCESS AND APPARATUS FOR FORMING A TUBULAR ARTICLE

(75) Inventors: Bradley Beach, Lexington, KY (US); James D. Gilmore, Lexington, KY (US); Jean M. Massie, Lexington, KY (US); Kathryn D. Mullins, Lexington, KY (US); John D. Ringo, Cambridge, MA (US); Gillian Ross, Lexington, KY (US); Scott S. Wu, Lexington, KY (US)

(73) Assignee: Lexmark Intellectual, Inc., Lexington, KY (US)

( * ) Notice: Subject to any disclaimer, the term of this patent is extended or adjusted under 35 U.S.C. 154(b) by 0 days.

(21) Appl. No.: 13/189,445

(22) Filed: Jul. 22, 2011

(65) Prior Publication Data

US 2011/0277687 A1 Nov. 17, 2011

Related U.S. Application Data

(62) Division of application No. 11/539,315, filed on Oct. 6, 2006, now Pat. No. 7,993,702.

(51) Int. Cl.
*B05C 7/08* (2006.01)

(52) U.S. Cl. ..... 118/215; 118/DIG. 10; 118/DIG. 13

(58) Field of Classification Search ..... 118/200, 118/254, 306, 317, 215, DIG. 10, DIG. 13; 264/36.16, 269; 15/104.16, 104.05, 104.061; 425/262, 460
See application file for complete search history.

(56) References Cited

U.S. PATENT DOCUMENTS

| | | | | |
|---|---|---|---|---|
| 3,233,924 | A * | 2/1966 | Stanley et al. | 285/322 |
| 4,800,104 | A * | 1/1989 | Cruickshank | 427/230 |
| 5,038,708 | A * | 8/1991 | Wells et al. | 118/318 |
| 2003/0196596 | A1 * | 10/2003 | Nishi et al. | 118/300 |
| 2006/0068092 | A1 * | 3/2006 | Horn | 427/230 |

FOREIGN PATENT DOCUMENTS

| | | | |
|---|---|---|---|
| GB | 2470193 | A * | 11/2010 |
| JP | 04131159 | A * | 5/1992 |

* cited by examiner

*Primary Examiner* — Yewebdar Tadesse

(57) ABSTRACT

An apparatus and process are provided for forming a tubular article. A tube holder is mounted to a support stand via an automatic alignment device. A tubular metal sleeve is placed in the tube holder. A coating material is provided. A bullet-shaped or spherical element is passed through the metal sleeve such that the element runs along an inner circumferential surface of the metal sleeve. The automatic alignment device allows the metal sleeve and the tube holder to level themselves such that the element is substantially aligned with the metal sleeve as the element moves through the metal sleeve. The element spreads the coating material generally evenly along the inner circumferential surface of the metal sleeve as the element passes through the metal sleeve.

23 Claims, 5 Drawing Sheets

PROCESS AND APPARATUS FOR FORMING A TUBULAR ARTICLE

CROSS REFERENCE TO RELATED APPLICATION

Pursuant to 37 C.F.R. §1.78, this application is a divisional application and claims the benefit of the earlier filing date of application Ser. No. 11/539,315, filed Oct. 6, 2006, now U.S. Pat. No. 7,993,702 entitled "Process and Apparatus for Forming a Tubular Article."

FIELD OF THE INVENTION

This invention relates to a process and apparatus for forming a tubular article. The tubular article may comprise part or all of an endless belt used in a fuser assembly for fixing a toner image to a substrate.

BACKGROUND OF THE INVENTION

In an electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to the media intended to receive the final permanent image. The toner image is fixed to the media by the application of heat and pressure in a fuser assembly. A fuser assembly may include a heated roll and a backup roll forming a fuser nip through which the media passes. A fuser assembly may also include a fuser belt and an opposing backup member, such as a backup roll.

In color EP imaging, time to first print from cold start is an important factor. In order to reduce time to first print, fuser assemblies comprising a ceramic heater, an endless fuser belt adapted to move across the ceramic heater and a backup roll have been used. These belt fuser assemblies typically have a low thermal mass resulting in short warm-up times. Example belt fuser assemblies are disclosed in U.S. Pat. No. 6,818,290 B1 and U.S. Patent Application Publication 2006/0067754 A1 (the '754 application), the disclosures of which are incorporated herein by reference. The endless belt disclosed in the '754 application comprises an inner base layer comprising polyimide with a thermally conductive filler, a metal layer adjacent the base layer, a first primer layer adjacent the metal layer, a thermally conductive elastic coating adjacent the first primer layer, a second primer layer adjacent the thermally conductive elastic coating, and an outer release layer.

U.S. Pat. No. 5,411,779 discloses a process for forming a composite tubular article comprising coating a fluoroplastic solution on an inner circumferential surface of a cylinder to form a tubular outer layer made of the fluoroplastic and further coating a poly(amic acid) solution on the inner circumferential surface of the fluoroplastic tubular layer, causing a bullet-shaped or spherical runner to run along the inner circumferential surface on which the poly(amic acid) solution has been coated, and subsequently imidizing the poly(amic acid) to form a tubular inner layer made of polyimide resin.

It is preferred that each layer of an endless belt in a belt fuser assembly have a consistent thickness so as to provide uniform heat transfer from the ceramic heater to substantially the entire surface of a toned substrate passing through the fuser assembly.

SUMMARY OF THE INVENTION

In accordance with a first aspect of the present invention, a process is provided for forming a tubular article comprising mounting a tube holder to a support stand via an automatic alignment device; placing a tubular metal sleeve in the tube holder; providing a coating material; and passing a bullet-shaped or spherical element through the metal sleeve such that the element runs along an inner circumferential surface of the metal sleeve. The automatic alignment device allows the metal sleeve and the tube holder to level themselves such that the element is substantially aligned with the metal sleeve, i.e., the element is substantially coaxial with the metal sleeve, during movement of the element through the metal sleeve. The element spreads the coating material generally evenly along the inner circumferential surface of the metal sleeve as the element passes through the metal sleeve.

The tube holder may be mounted to the support stand via an automatic alignment device comprising a first element supported by the support stand, a second element pivotably supported on the first element, and first and second support members on the tube holder for engaging the second element such that the tube holder is pivotably supported on the second element.

The tubular metal sleeve may be placed in the tube holder such that a longitudinal axis of the tubular sleeve is substantially vertically oriented.

The tubular metal sleeve may be formed from one of stainless steel and copper.

The coating material may comprise a polyamic acid solution.

The process may further comprise the step of removing the metal sleeve from the tube holder after the element has passed through the metal sleeve and placing the metal sleeve on a rolling rack in an oven wherein the polyamic acid solution is dried to a substantially solid film layer. The process may still further comprise imidizing the polyamic acid solid film layer such that a polyimide inner layer is formed on the inner circumferential surface of the metal sleeve.

The polyamic acid solution may contain a thermally conductive filler, such as one of a metal oxide and boron nitride.

In accordance with a second aspect of the present invention, a process is provided for forming a tubular article comprising providing a coating material comprising a polyamic acid solution, and passing a bullet-shaped or spherical element through a metal sleeve such that the element runs along an inner circumferential surface of the metal sleeve. The element spreads the coating material generally evenly along the inner circumferential surface of the metal sleeve as the element passes through the metal sleeve. The process further comprises removing the metal sleeve from the tube holder after the element has passed through the metal sleeve and placing the metal sleeve on a rolling rack in an oven wherein the polyamic acid solution is dried to a substantially solid film layer.

Preferably, the metal sleeve is place on the rolling rack such that it is horizontally positioned on the rolling rack.

In accordance with a third aspect of the present invention, an apparatus is provided for applying a generally uniform layer of coating material on an inner circumferential surface of a metal sleeve. The apparatus comprises a support stand; a tube holder; an automatic alignment device for mounting the tube holder to the support stand; and a bullet-shaped or spherical element adapted to pass through the metal sleeve such that the element runs along the inner circumferential surface of the metal sleeve. The automatic alignment device allows the metal sleeve and the tube holder to level themselves such that the element is substantially aligned with the metal sleeve as the element moves through the metal sleeve. The element spreads the coating material generally evenly along the inner circumferential surface of the metal sleeve as the element passes through the metal sleeve.

DETAILED DESCRIPTION OF THE INVENTION

Figure 1:
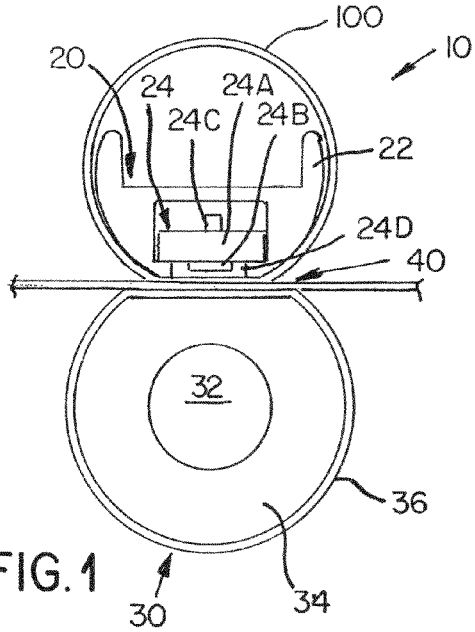
FIG. 1 is a side, cross sectional view of a belt fuser assembly including a belt formed in accordance with the present invention.

A fuser assembly 10 including an endless flexible fuser belt 100 formed in accordance with the present invention is illustrated in FIG. 1. The fuser assembly 10 further comprises a heater assembly 20 and a backup member in the form of a roll 30. In the illustrated embodiment, the backup roll 30 is driven and the fuser belt 100 is an idler belt. However, the drive scheme may be reversed. The fuser belt 100 and the backup roll 30 define a fuser nip 40 therebetween.

Heater assembly 20 comprises a high temperature housing 22 formed from a polymeric material such as a liquid crystal polymer. A ceramic heater 24 is fixed to the housing 22. The heater 24 may comprise a ceramic substrate 24A formed, for example, from alumina, a resistive ink pattern 24B provided on the substrate 24A, a temperature sensor 24C such as a thermistor, and a glass protective layer 24D provided over the pattern 24B and adjacent exposed portions of the ceramic substrate 24A. One such heater 24 is disclosed in U.S. Patent Application Publication 2004/0035843 A1, the disclosure of which is incorporated herein by reference.

The backup roll 30 may comprise an inner core 32, an inner polymeric layer 34 and an outer toner release layer or sleeve 36. The inner core 32 may be formed from a polymeric material, steel, aluminum or a like material. The inner polymeric layer 34 may be formed from a silicone foam or rubber material. The outer release layer 36 may be formed from PFA (polyperfluoroalkoxy-tetrafluoroethylene) or other fluororesin material. A conventional drive mechanism (not shown) is provided for effecting rotation of the backup roll 30.

A substrate transport device (not shown), such as a belt, may be provided to feed substrates S, see FIG. 1, one a time into the fuser nip 40. A toner image is provided on each substrate via one or more imaging stations, such as disclosed in U.S. Patent Application Publication 2006/0067754 A1, the disclosure of which has previously been incorporated herein by reference. The toner image is fused to the substrate S by the belt 100, the ceramic heater 24 and the backup roll 30 applying heat and pressure to the substrate/toner image. In the illustrated embodiment, rotation of the backup roll 30 effects movement of a substrate S through the fuser nip 40. Movement of the backup roll 30 and substrate S causes the fuser belt 100 to move relative to the ceramic heater 24.

Figure 1A:
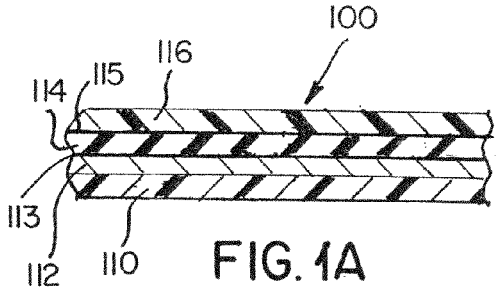
FIG. 1A is a cross sectional view of a portion of the belt illustrated in FIG. 1.

Referring now to FIG. 1A, the belt 100 may comprise an inner base polyimide layer 110; a metal layer 112; a first primer layer 113 provided over the metal layer 112; an elastomer layer 114; a second primer layer 115 provided adjacent the elastomer layer 114; and an outer toner release layer or sleeve 116 provided over the elastomer layer 114.

The polyimide layer 110 may include boron nitride or a metal oxide such as aluminum oxide or zinc oxide to improve the thermal properties of the layer 110. For example, the polyimide layer 110 may comprise boron nitride or a metal oxide in an amount of from about 10% to about 50% by weight, based on the total weight of the polyimide material and boron nitride or metal oxide comprising the layer 110. In one embodiment, the polyimide layer 110 includes boron nitride in an amount of about 23% by weight, based on the total weight of the polyimide material and the boron nitride comprising the layer 110. Preferably, the polyimide layer 110 has a thickness of from about 5 microns to about 30 microns. The polyimide layer 110 prevents wear of the ceramic heater 24 due to the belt 100 moving along the ceramic heater 24. The polyimide layer 110 also provides electrical insulation properties and flexibility to the belt 100. The belt 100 preferably is sufficiently stiff to prevent buckling yet flexible enough to conform to the fuser nip 40 and varying toner material heights on the substrates S. A process for forming the polyimide layer 110 on an inner circumferential surface of a cylindrical metal sleeve 112A defining the metal layer 112 will be described below.

The cylindrical metal sleeve 112A defining the metal layer 112 may be formed from stainless steel, copper or a like material. The metal sleeve 112A preferably has a thickness of between about 30 microns to about 100 microns.

The first primer layer 113 may have a thickness of between about 1 micron to about 5 microns. A primer such as one commercially available from Shin-Etsu under the product designation "X-33-156-20" may be used as the material for the first primer layer. The material used to form the first primer layer may be spray coated or brushed onto an outer surface of the metal sleeve 112A. Preferably, the first primer layer 113 is formed on the metal sleeve 112A after the polyimide layer 110 has been formed on the inner circumferential surface of the metal sleeve 112A.

The elastomer material in the elastomer layer 114 preferably comprises a silicone rubber having a durometer of less than 60 shore A, and preferably between 5 to 35 shore A. An example elastomer material is available from Shin-Etsu under the product designation "X-34-2744." The elastomer layer 114 may include zinc or aluminum oxide to improve the thermal properties of the elastomer layer 114. For example, the elastomer layer 114 may include zinc or aluminum oxide in an amount of from about 30% to about 90% by weight, based on the total weight of the elastomer material and zinc or aluminum oxide comprising the layer 114. Preferably, the elastomer layer 114 may have a thickness of between about 150 microns to about 600 microns. The silicone rubber and zinc or aluminum oxide mixture may be liquid-injection molded between the metal sleeve 112A and a PFA (polyperfluoroalkoxy-tetrafluoroethylene) sleeve defining the release layer 116. Prior to the injection molding operation, the first primer layer 113 is provided on the metal sleeve 112A and the second primer layer 115 is provided on an inner surface of the PFA sleeve. Preferably, the elastomer layer 114 is thick enough and soft enough to conform to the changing heights of the toner material defining the toner images on the substrates S, yet is thermally conductive enough to be used in a high speed, low thermal mass fuser assembly.

The second primer layer 115 is spray coated or brushed onto the inner circumferential surface of the PFA sleeve. The second primer layer 115 may have a thickness of between about 1 micron to about 5 microns. The second primer layer allows for the adhesion of the elastomer layer 114 with the release layer 116. A primer such as one commercially available from Shin-Etsu under the product designation "X-33-183A/B" may be used as the material for the second primer layer 115.

As noted above, the release layer 116 may comprise a PFA (polyperfluoroalkoxy-tetrafluoroethylene) sleeve having a thickness of between about 5 microns to about 100 microns, and preferably between about 25 microns to about 50 microns. The release layer 116 may also be formed from other fluororesin materials.

A process for forming the polyimide layer 110 on an inner circumferential surface of a metal sleeve 112A will now be described.

Initially, a generally uniform layer of a coating material comprising a polyamic acid solution is applied to the inner circumferential surface of the metal sleeve 112A using the apparatus 200 illustrated in FIGS. 2-6, 5A and 5B. Thereafter, the polyamic acid solution is dried and cured so as to form a polyimide layer on the inner circumferential surface of the metal sleeve 112A. The metal sleeve 112A and the polyimide layer 110 define a tubular article.

The apparatus 200 for applying a generally uniform layer of the coating material to the inner circumferential surface of the metal sleeve 112A comprises a support stand 210; a tube holder 220; an automatic alignment device 230 for supporting the tube holder 220 on the support stand 210; and a bullet-shaped element 240 adapted to pass through the metal sleeve 112A via gravity such that the element 240 runs along the inner circumferential surface of the metal sleeve 112A, see FIGS. 2-6, 5A and 5B.

The tube holder 220 comprises a main body 222 and a cap 322 threadedly coupled to said main body 222. The main body 222 includes a bore 222A, a first end 222B and a second end 222C, see FIGS. 5A and 5B. The cap 322 includes an inner bore 322A having an inner diameter less than an inner diameter of the main body bore 222A. Hence, when the cap 322 is threaded onto the main body 222, a lower end 322B of the cap 322 defines a step 322C, see FIGS. 5A and 5B. The bore 322A is generally coaxial with the bore 222A.

The first end 222B of the main body 222 is defined by spaced-apart teeth 223, see FIGS. 2, 3, 5A and 5B, which are biased in a direction away from an internal central axis of the main body 222. The teeth 223 have external threads 223A. A collet 224, provided with internal threads 224A, is mounted over the teeth 223. The threads 224A on the collet 224 engage with the threads 223A on the teeth 223 so that rotation of the collet 224 relative to the main body 222 causes the collet 224 to move along the length of the teeth 223. When the collet 224 is rotated in a direction causing it to move toward the second end 222C of the main body 222, the teeth 223 are permitted to flex outwardly to an expanded position. With the teeth 223 expanded, a tubular metal sleeve 112A may be manually inserted into the bore 222A of the tube holder main body 222. Preferably, an upper end 312A of the metal sleeve 112A engages the step 322C defined by the lower end 322B of the cap 322 to prevent the metal sleeve 112A from extending into the cap 322. Once the metal sleeve 112A has been inserted into and correctly positioned within the tube holder 220, the collet 224 is rotated in a direction causing it to move downwardly away from the second end 222C of the main body 222, such that the teeth 223 compress inwardly and engage the metal sleeve 112A. The compressed teeth 223 maintain the sleeve 112A secured in the tube holder main body 222. When secured in the main body 222, the metal sleeve 112A is generally concentric with the main body bore 222A.

After the tubular metal sleeve 112A is secured in the tube holder 220, the tube holder 220 is mounted to the support stand 210 via the automatic alignment device 230. The support stand 210 includes a generally horizontal support plate 212 having a stepped opening 212A, see FIGS. 5A and 5B. In the embodiment illustrated in FIGS. 2-6, 5A and 5B, the automatic alignment device 230 comprises a first annular element 232 having a pair of diametrically opposed V-notches 232A and 232B, see FIGS. 2, 5 and 5A. The first annular element 232 is received in the stepped open 212A in the support stand 210 so as not to move relative to the support stand 210, see FIGS. 5A and 5B. The first annular element 232 defines an opening 232C for receiving a second annular element 234, the tube holder 220 and the metal sleeve 112A held by the tube holder 220.

The automatic alignment device 230 further comprises a second annular element 234 comprising an annular body 330 and diametrically opposed first and second shaft/roller assemblies 332 and 334, see FIGS. 2-5, 5A and 5B. The first shaft/roller assembly 332 comprises a first shaft 332A extending outwardly from the annular body 330 and a first roller 332B rotatably coupled to the first shaft 332A. The second shaft/roller assembly 334 comprises a second shaft 334A extending outwardly from the annular body 330 and a second roller 334B rotatably coupled to the second shaft 334A. The annular body 330 includes an opening 330A, see FIG. 5.

The annular body 330 of the second annular element 234 is received within the opening 232C defined by the first annular element 232. The second annular element 234 is supported on the first annular element 232 via its first and second rollers 332A and 334B, which engage, i.e., are seated within, the V-notches 232A and 232B formed in the first annular element 232. Hence, the second annular element 234 is able to pivot or rotate relative to the first annular element 232 along an axis $A_1$ passing through the first and second shafts 332A and 334A of the second annular element 234, see FIG. 5. The second annular element further comprises a pair of diametrically opposed V-notches 234A and 234B, see FIGS. 2-5 and 5B.

Figure 2:
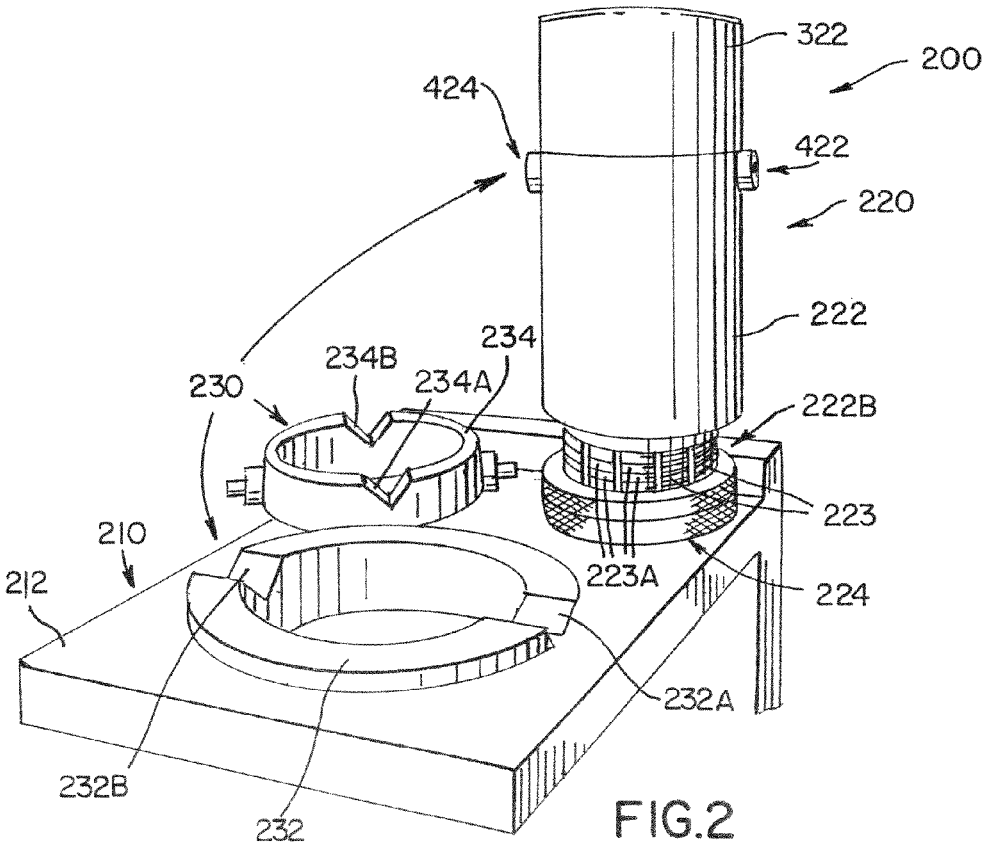
FIG. 2 is a view of an apparatus for applying a generally uniform layer of coating material to an inner circumferential surface of a tubular sleeve, wherein a tube holder and a second element of an automatic alignment device are shown separated from a first element of the automatic alignment device.
Figure 3:
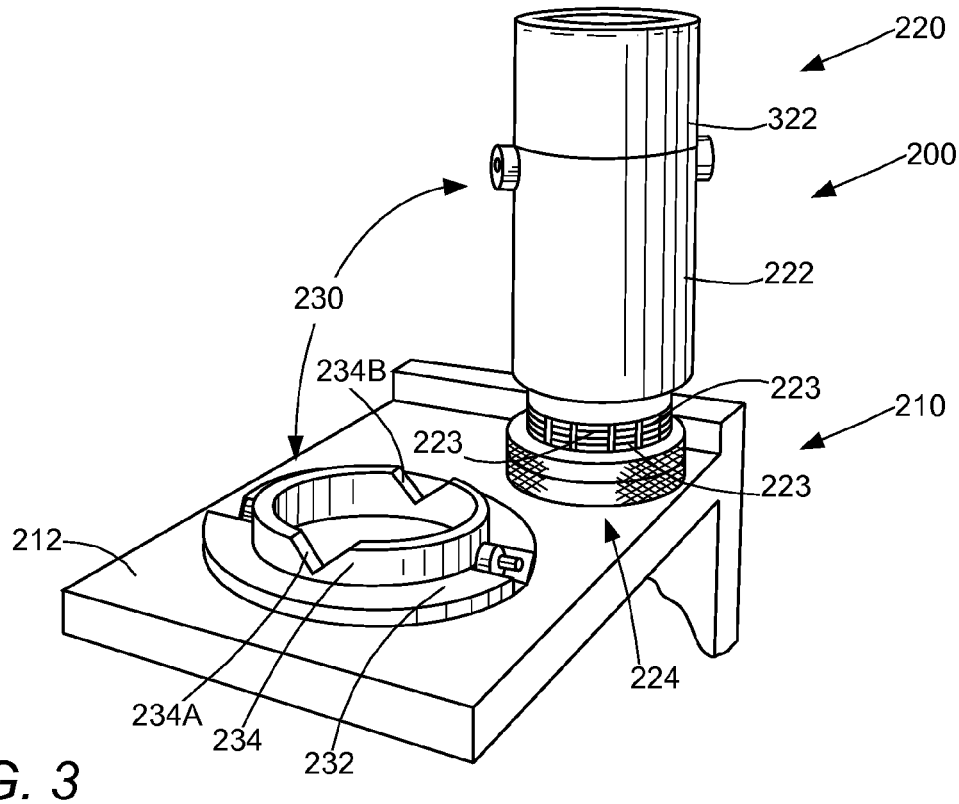
FIG. 3 is view of the apparatus shown in FIG. 2 with the second element engaged with the first element.
Figure 4:
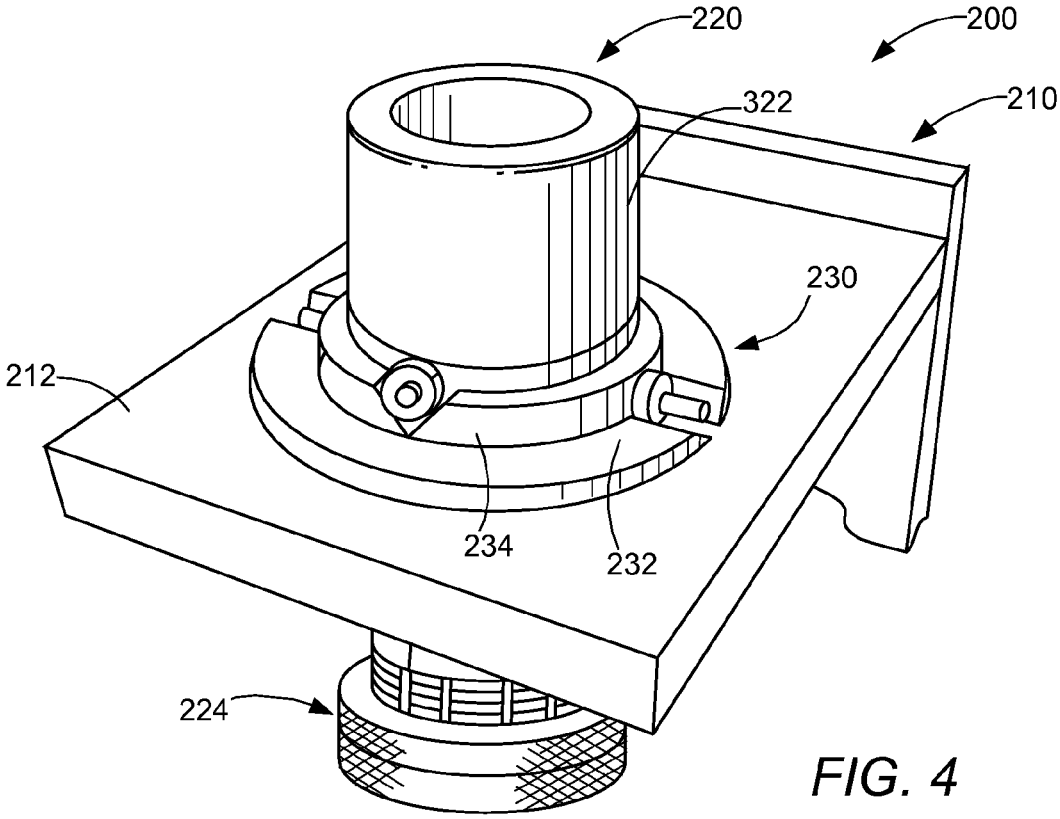
FIG. 4 is a view of the apparatus shown in FIG. 3 with the tube holder positioned within the first and second elements of the alignment device.
Figure 5:
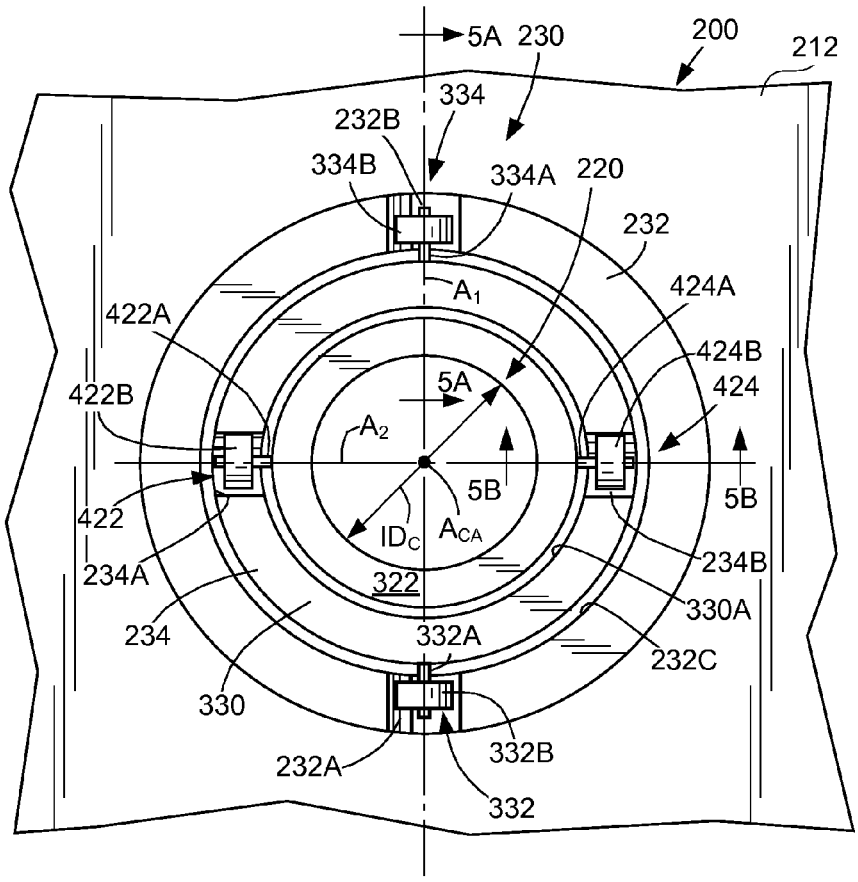
FIG. 5 is plan view of the apparatus illustrated in FIG. 4.
Figure 5A:
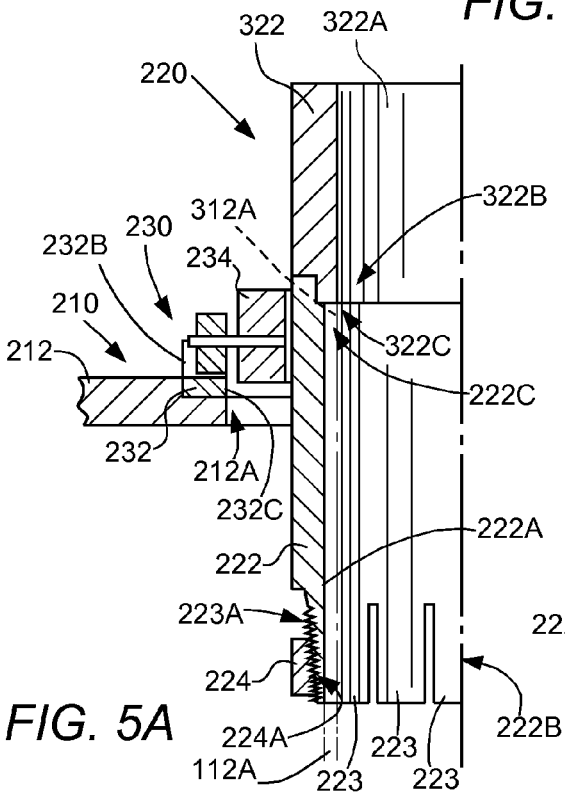
FIG. 5A is a view taken along view line 5A-5A in FIG. 5.
Figure 5B:
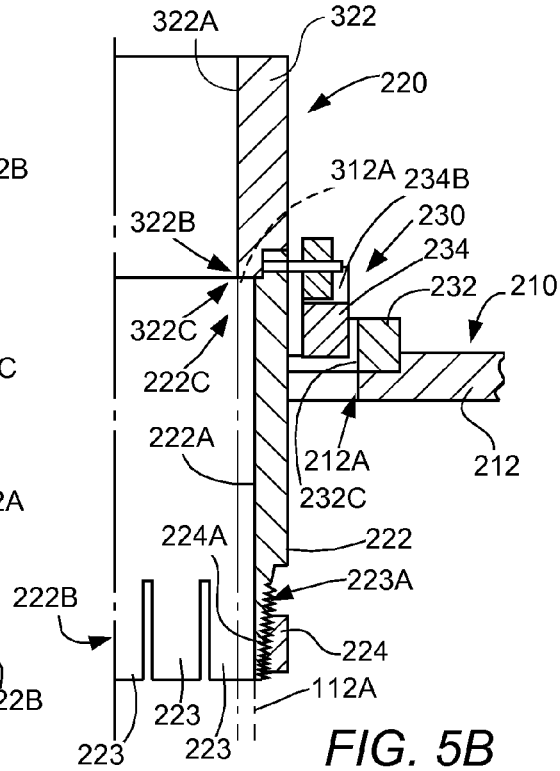
FIG. 5B is a view taken along view line 5B-5B in FIG. 5.
Figure 6:
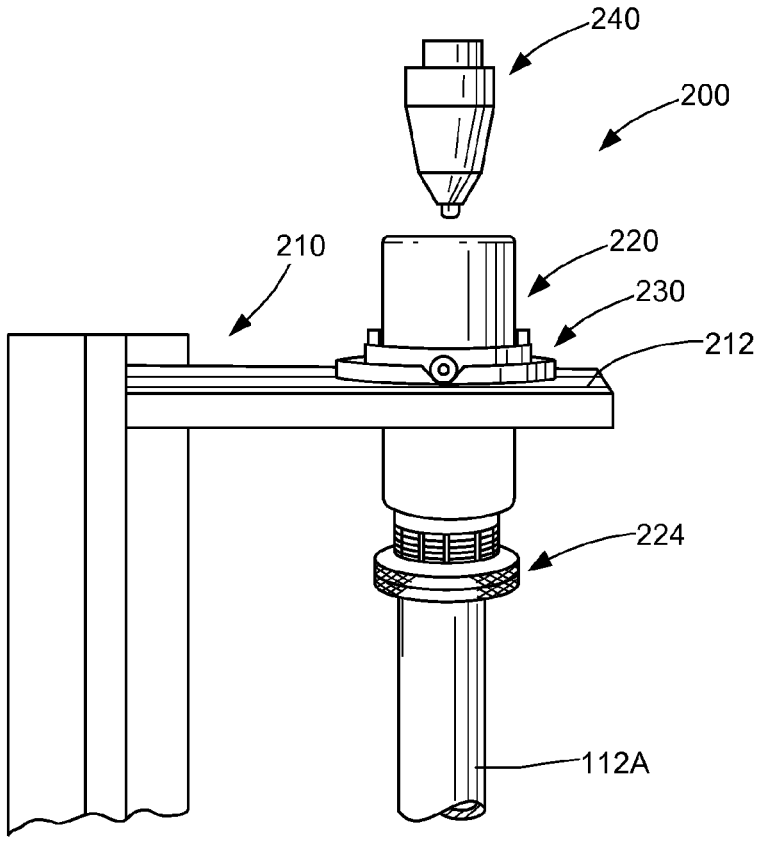
FIG. 6 is a view of the apparatus shown in FIG. 4 with a tubular sleeve mounted within the tube holder and a bullet-shaped element positioned over the tubular sleeve.

First and second support members 422 and 424 are mounted on the main body 222 of the tube holder 220, see FIGS. 2 and 5. Each support member 422, 424 comprises a shaft 422A, 424A and a roller 422B, 424B rotatably mounted on a corresponding shaft 422A, 422B. The tube holder 220 and a metal sleeve 112A held within the tube holder 220 are inserted through the openings 232C and 330A in the first and second annular elements 232 and 234. The tube holder 220 is then supported on the second annular element 234 via the rollers 422B and 424B engaging with, i.e., being received within, the V-notches 234A and 234B formed within the second annular element 234. Hence, the tube holder 220 and the metal sleeve 112A mounted within the tube holder 220 are able to pivot or rotate relative to the second annular element 234 along a second axis $A_2$ passing through the shafts 422A and 424A of the first and second support members 422 and 424. Further, the tube holder 220, the metal sleeve 112A mounted within the tube holder 220 and the second annular element 234 are able to pivot or rotate relative to the first annular element 232 along the axis $A_1$ passing through the first and second shafts 332A and 334A of the second annular element 234. As is apparent from FIG. 5, the first axis $A_1$ is substantially transverse to the second axis $A_2$.

Because the tube holder 220 and the metal sleeve 112A mounted within the tube holder 220 are able to freely rotate about the first and second axes $A_1$ and $A_2$, which axes $A_1$ and $A_2$ are substantially transverse to one another, the automatic alignment device 230 allows the tube holder 220 and the metal sleeve 112A to level themselves in response to gravitational forces such that a central axis $A_{CA}$ of the tube holder 220 is generally parallel to vertical, i.e., the direction of the force of gravity.

After the tube holder 220/metal sleeve 112A have been mounted to the support stand 210 via the automatic alignment device 230, a polyamic acid solution is applied to the inner bore 322A of the tube holder cap 322 such as by a syringe or nozzle. The bullet-shaped element 240 is then manually centered over the inner bore 322A in the cap 322, see FIG. 6, and released. The bullet-shaped element 240 moves downwardly via gravity through the cap 322 and the metal sleeve 112A. The inner bore 322A is preferably sized so as to have an inner diameter $ID_c$ only slightly greater than an outer diameter of the bullet-shaped element 240, such as by twice the wet thickness of the polyimide layer 110 and a tolerance value. Further, as noted above, the bore 322A is generally coaxial with the bore 222A of the tube holder 220. Hence, the bullet-shaped element 240 is centered by the cap 322 relative to the tube holder 220 and the metal sleeve 112A as the bullet-shaped element 240 passes through the cap inner bore 322A. The bullet-shaped element 240 pushes or moves a substantial portion of the polyamic acid solution previously applied to the inner bore 322A of the cap 322 into the metal sleeve 112A. As the bullet-shaped element 240 passes through the metal sleeve 112A, it runs along the inner circumferential surface of the metal sleeve 112A so as to spread the polyamic acid solution generally evenly along the inner circumferential surface of the metal sleeve 112A. Because the automatic alignment device 230 allows the tube holder 220 and metal sleeve 112A to self-align relative to vertical prior to and/or during the bullet-shaped element 240 passing through the metal sleeve 112A, the bullet-shaped element 240 moves through the tube holder 220 and the metal sleeve 112A along an axis parallel to vertical and, further, is substantially aligned with the metal sleeve 112A, i.e., the bullet-shaped element 240 is substantially coaxial with the metal sleeve 112A, as the bullet-shaped element 240 moves through the metal sleeve 112A. Hence, a generally uniform coating of the polyamic acid solution is formed on the inner circumferential surface of the metal sleeve 112A as the bullet-shaped element 240 passes through the metal sleeve 112A.

The difference between the outer diameter of the bullet-shaped element 240 and the inner diameter of the metal sleeve 112A, divided by 2, defines the wet thickness of the coating of the polyamic acid solution on the inner circumferential surface of the metal sleeve 112A and a small tolerance value.

It is contemplated that the element 240 may have a spherical shape instead of the bullet shape in the illustrated embodiment.

The polyamic acid solution may be obtained by combining polyamic acid, such as 3,3',4,4'-biphenyltetracarboxylicdianhydride-co-1,4-phenylenediamine amic acid with a solvent such as N-methyl-2-pyrrolidinone. The typical polyamic acid concentration in the polyamic acid solution ranges from about 10-20% by weight. Boron nitride powder may be incorporated into the polyamic acid solution in an attritor mill using stainless steel shot as the mill media.

A typical procedure for forming the polyimide layer 110 is as follows:

A 480 g solution of polyamic acid and N-methyl-2-pyrrolidinone is weighed, wherein the solution comprises 14% by weight polyamic acid and 86% by weight N-methyl-2-pyrrolidinone. 19.6 grams of boron nitride (0.3-0.7 microns) are added to the solution. These materials are added to an attritor and milled with 1500 grams of ⅜ inch stainless steel milling media for a period of about 6 hrs at 500 RPM until a smooth dispersion is obtained. The attritor is cooled with chilled water during the milling process to maintain the solution temperature to less than 50 degrees C. The dispersion is then strained and filtered to remove the milling media and any particles over 30 microns in diameter. Once dried and imidized, a polyimide layer with 23% by weight of boron nitride is formed.

The dispersion or polyamic acid solution is coated onto the inner bore 322A of the cap 322. While the combination of a polyamic acid solution and boron nitride or a metal oxide is referred to herein as a dispersion, the combination is also referred to herein and defined for purposes of this application as being a polyamic acid solution. Hence, for purposes of this patent application, a polyamic acid solution is defined to include or not include boron nitride or a metal oxide.

After the bullet-shaped element 240 has passed through the metal sleeve 112A causing a generally uniform coating of the polyamic acid solution to be formed on the inner circumferential surface of the metal sleeve 112A, the collet 224 on the main body 222 is moved in a direction toward the second end 222C of the main body 222 to release the coated metal sleeve 112A from the main body 222. The coated metal sleeve 112A is then removed from the tube holder 220. Thereafter, the polyamic acid solution coating is dried and cured so as to form a polyimide layer on the inner circumferential surface of the metal sleeve 112A.

Figure 7:
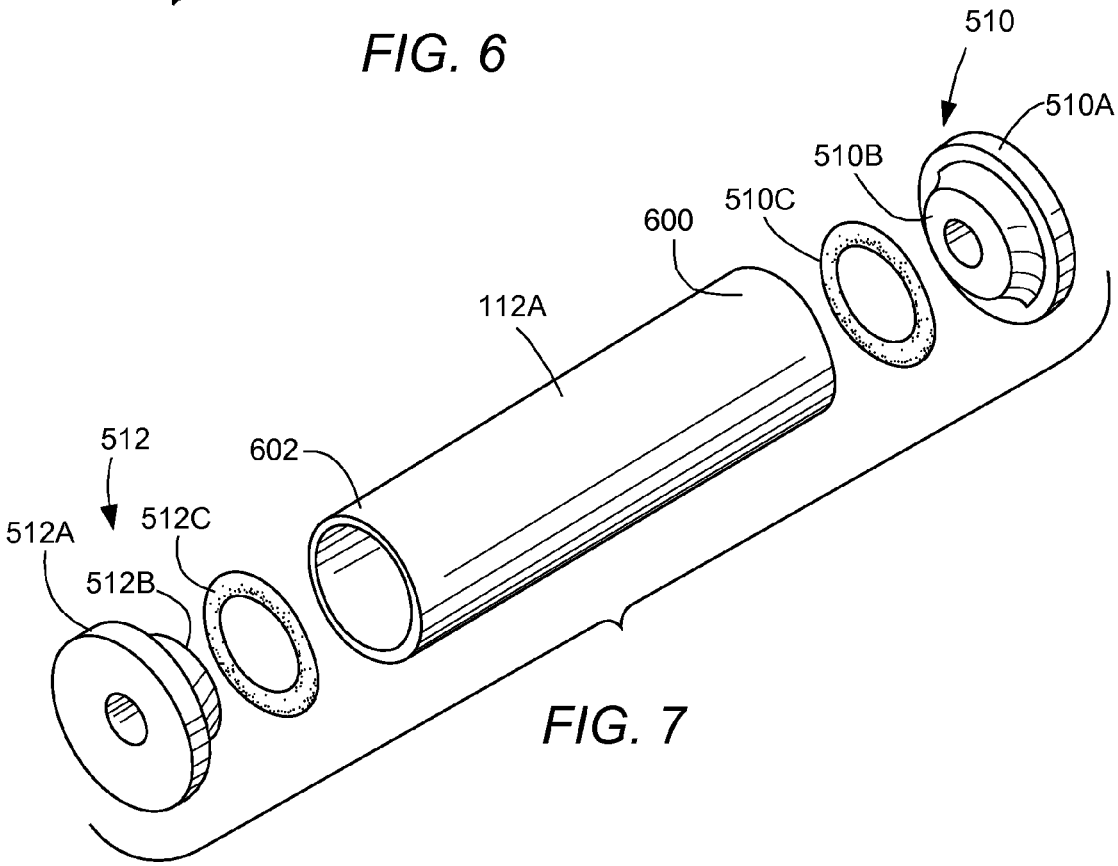
FIG. 7 is a view of a tubular article comprising a tubular sleeve having a layer of coating material on its inner circumferential surface and first and second endcap assemblies separated from the tubular article.
Figure 8:
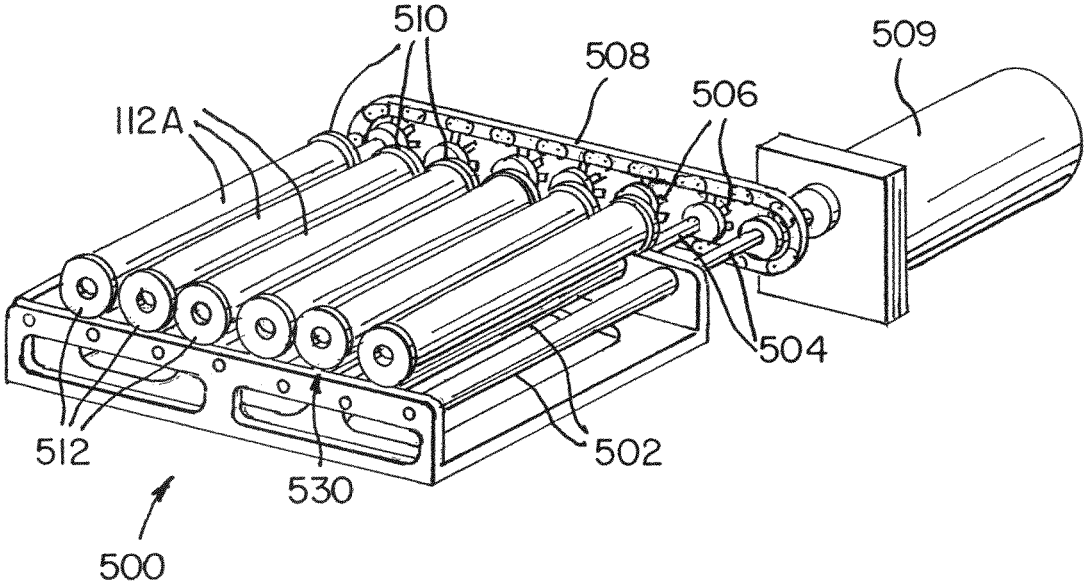
FIG. 8 is a perspective view of a rolling rack adapted to be received in an oven and shown horizontally supporting one or more tubular articles, each in combination with first and second endcap assemblies.

Preferably, the coated metal sleeve 112A is mounted on a rolling rack 500, see FIG. 8, which is placed in an oven (not shown), to effect the drying of the polyamic acid solution. Prior to being positioned on the rolling rack 500, first and second endcap assemblies 510 and 512 are mounted on opposite ends 600 and 602 of the coated metal sleeve 112A, see FIG. 7. Each endcap assembly 510, 512 comprises a metal endcap 510A, 512A having a protruding portion 510B, 512B. A polymeric O-ring 510C, 512C is mounted on each protruding portion 510B, 512B. The protruding portions 510B, 512B including the O-rings 510C, 512C are received in the opposite ends 600 and 602 of the coated metal sleeve 112A and are held therein via a friction fit.

The rolling rack 500 comprises a plurality of rolls 502, each having an axle 504 provided with a corresponding gear 506. The gears 506 are driven by a chain 508 and a motor 509 so as to effect rotation of the rolls 502. The coated metal sleeve 112A in combination with its first and second endcap assemblies 510 and 512 is horizontally mounted in a gap 530 between a pair of adjacent rolls 502 so as to be rotated by the rolls 502. A plurality of coated metal sleeve/endcap assembly combinations may be mounted on the rolling rack 500 simultaneously. Each coated metal sleeve 112A preferably dries on the rolling rack 500 within a low air-flow convection oven. The material is slowly heated from room temperature to 125 degrees C. in about 90 minutes, then held at 125 degrees C. for 60 minutes until the polyamic acid solution has dried to a substantially solid film layer. If the material is dried too quickly, the film will be filled with air bubbles and the material can also blister. Rotation of the coated metal sleeve 112A while in the oven allows the polyamic acid solution to dry having a consistent thickness all along and around the film layer.

Once the polyamic acid solution has dried to a solid film layer, the coated metal sleeve 112A may be removed from the rolling rack 500 and placed in the same or another oven so as to allow the polyamic acid solution film layer to be imidized. For example, the coated metal sleeve 112A may be placed in an oven for 30 minutes at 200 degrees C.; 80 minutes at 250 degrees C.; then 60 minutes at an imidization temperature of 380 degrees C. The oven is ramped at a 20 degree C. per minute rate between temperatures.

Once the polyamic acid solution has imidized to form a polyimide layer 110 on the inner circumferential surface of the metal sleeve 112A, the primer layer 113, the elastomer layer 114, the second primer layer 115 and the release layer 116 may be formed on the metal sleeve 112A.

It is contemplated that the automatic alignment device may alternatively comprise a self-aligning bearing or like element.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus for applying a generally uniform layer of coating material on an inner circumferential surface of a metal sleeve, said apparatus comprising:

a support stand;

a tube holder;

an automatic alignment device for mounting said tube holder to said support stand; and an element having one of bullet and spherical shape for passing through the metal sleeve such that the element runs along the inner circumferential surface of the metal sleeve, the automatic alignment device allowing the metal sleeve and the tube holder to level themselves such that the element is substantially aligned with the metal sleeve during movement of the element through the metal sleeve, the element spreading the coating material generally evenly along the inner circumferential surface of the metal sleeve as the element passes through the metal sleeve;

wherein the automatic alignment device includes a first element supported by the support stand, a second element supported on the first element, and first and second support members on the tube holder, the first and second support members of the tube holder protruding from an outer surface of the tube holder and the second element having a plurality of notches defined along an upper portion thereof such that the first and second support members are received by a distinct notch.

2. The apparatus of claim 1, wherein said automatic alignment device positions the first and second support members on said tube holder for engaging said second element such that said tube holder is pivotably supported on said second element.

3. The apparatus of claim 2, wherein said second element comprises first and second support assemblies extending from an outer surface thereof, and said first element including a plurality of notches defined along an upper portion thereof such that the first and second support assemblies of said second element are received by a distinct notch.

4. The apparatus of claim 3, wherein said first and second support assemblies define an axis about which the second element pivots relative to said first element.

5. The apparatus of claim 1, wherein said first and second support members define an axis about which the tube holder pivots relative to said second element.

6. The apparatus of claim 1, wherein said second element is pivotably supported on said first element, said second element comprises first and second support assemblies extending from an outer surface thereof, and said first element comprises a plurality of notches defined along an upper portion thereof such that the first and second support assemblies of said second element are received by a distinct notch.

7. The apparatus of claim 6, wherein said first and second support assemblies define an axis about which the second element pivots relative to said first element.

8. The apparatus of claim 1, wherein said automatic alignment device comprises a first element supported by said support stand, a second element supported on said first element, said tube holder supported by said second element, and first and second support assemblies on said second element for engaging said first element, said first and second support assemblies defining an axis about which said second element pivots relative to said first element.

9. The apparatus of claim 1, wherein said tube holder includes a plurality of spaced-apart teeth circumferentially disposed about said tube holder and threads defined along an outer surface of said teeth, and said apparatus further comprising a collet for threadingly engaging with said threads for clamping the metal sleeve to said tube holder.

10. The apparatus of claim 1, wherein the element passes through the metal sleeve due to gravity to cause the coating material to spread generally substantially evenly along the inner circumferential surface of the metal sleeve as the element passes therethrough.

11. An apparatus for coating an inner surface of a sleeve, comprising:

a support;

a tube holder for holding a sleeve in a stationary position relative thereto;

an alignment device for mounting the tube holder to the support so that a longitudinal axis of the sleeve is automatically positioned substantially vertically; and an element for passing through the sleeve when held by the tube holder such that the element runs along the inner circumferential surface of the sleeve, the alignment device allowing the sleeve and the tube holder to level themselves such that the element is substantially aligned with the sleeve during movement of the element through the sleeve, the element spreading the coating material substantially evenly along the inner circumferential surface of the sleeve as the element passes through the sleeve.

12. The apparatus of claim 11, wherein the alignment device comprises a first element supported by the support, a second element supported on the first element, and first and second support members on the tube holder for engaging the second element such that the tube holder is pivotably supported on the second element.

13. The apparatus of claim 12, wherein the first and second support members of the tube holder protrude from an outer surface of the tube holder and the second element includes a plurality of notches defined along an upper portion thereof such that the first and second support members are received by a distinct notch, the first and second support members defining an axis about which the tube holder pivots relative to the second element.

14. The apparatus of claim 13, wherein the second element is pivotably supported on the first element, the second element comprises first and second support assemblies extending from an outer surface thereof, and the first element comprises a plurality of notches defined along an upper portion thereof such that the first and second support assemblies of the second element are received by a distinct notch of the first element, the first and second support assemblies of the second element defining a second axis about which the second element pivots relative to the first element.

15. The apparatus of claim 11, wherein the alignment device comprises a first element supported by the support, a second element pivotably supported on the first element, the second element supporting the tube holder, and first and second support assemblies on the second element for engaging the first element such that the second element is supported on the first element.

16. The apparatus of claim 15, wherein the first and second support assemblies of the second element protrude from an outer surface thereof and the first element includes a plurality of notches defined along an upper portion thereof such that the first and second support assemblies of the second element are received by a distinct notch, the first and second support assemblies defining an axis about which the second element pivots relative to the first element.

17. The apparatus of claim 11, wherein the element passes through the sleeve via gravity induced motion.

18. An apparatus for applying a generally uniform layer of coating material on an inner circumferential surface of a sleeve, said apparatus comprising:

a support stand;

a tube holder;

an automatic alignment device for mounting said tube holder to said support stand; and an element for passing through the sleeve such that the element runs along the inner circumferential surface of the sleeve, the automatic alignment device allowing the sleeve and the tube holder to level themselves such that the element is substantially aligned with the sleeve during movement of the element through the sleeve, the element spreading the coating material generally evenly along the inner circumferential surface of the sleeve as the element passes through the sleeve;

wherein the automatic alignment device comprises a first element supported by the support stand, a second element supported on the first element, and first and second support members on the tube holder for engaging the second element such that the tube holder is pivotably supported on the second element, the second element having first and second support structures extending from an outer surface thereof, and the first element including a plurality of notches defined along an upper portion thereof such that the first and second support structures of the second element are received by a distinct notch.

19. The apparatus of claim 18, wherein said first and second support members define an axis about which the second element pivots relative to said first element.

20. An apparatus for applying a generally uniform layer of coating material on an inner surface of a sleeve, the apparatus comprising:

a support stand;

a tube holder;

an automatic alignment device coupled to the support stand and the tube holder, for mounting the tube holder to the support stand and causing the sleeve and the tube holder to automatically level themselves relative to the support stand; and an element for passing through the sleeve such that the element moves along the inner surface of the sleeve via gravity induced motion, the element spreading the coating material generally evenly along the inner surface of the sleeve as the element moves through the sleeve.

21. The apparatus of claim 20, wherein the automatic alignment device comprises a first element supported by the support stand, a second element supported on the first element, and first and second support members on the tube holder for engaging the second element such that the tube holder is pivotably supported on the second element to pivot about a first axis, and the second element being pivotably supported on the first element to pivot about a second axis different from the first axis.

22. The apparatus of claim 20, wherein the second element has first and second support structures extending from an outer surface thereof, and the first element including a plurality of notches defined along an upper portion thereof such that the first and second support assemblies of the second element are received by a distinct notch.

23. The apparatus of claim 22, wherein the tube holder has first and second support members protruding from an outer surface of the tube holder and the second element has a plurality of notches defined along an upper portion thereof such that the first and second support members are received by a distinct notch.

* * * * *